US009172158B2

(12) United States Patent
Akuta

(10) Patent No.: US 9,172,158 B2
(45) Date of Patent: Oct. 27, 2015

(54) TERMINAL BLOCK

(71) Applicant: Sumitomo Wiring Systems, Ltd., Yokkaichi, Mie (JP)

(72) Inventor: Daisuke Akuta, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 58 days.

(21) Appl. No.: 14/071,946

(22) Filed: Nov. 5, 2013

(65) Prior Publication Data

US 2014/0134897 A1 May 15, 2014

(30) Foreign Application Priority Data

Nov. 13, 2012 (JP) ..... 2012-249566

(51) Int. Cl.

| | |
|---|---|
| ***H01R 4/30*** | (2006.01) |
| ***H01R 9/18*** | (2006.01) |
| ***H01R 9/24*** | (2006.01) |
| *H01R 11/12* | (2006.01) |

(52) U.S. Cl.

CPC .. *H01R 9/18* (2013.01); *H01R 4/30* (2013.01); *H01R 9/24* (2013.01); *H01R 11/12* (2013.01)

(58) Field of Classification Search

CPC ..... H01R 9/18; H01R 9/24; H01R 4/30; H01R 4/34; H01R 9/223; H01R 9/26; H01R 4/2429; H01R 9/22; H01R 12/515; H01R 9/2416; H01R 9/2675

See application file for complete search history.

(56) References Cited

U.S. PATENT DOCUMENTS

| | | | | |
|---|---|---|---|---|
| 8,142,234 | B2 * | 3/2012 | Kaneshiro | 439/709 |
| 8,465,331 | B2 * | 6/2013 | Shimowake et al. | 439/709 |
| 8,702,361 | B2 * | 4/2014 | Akuta | 411/103 |
| 2011/0117792 | A1 | 5/2011 | Kaneshiro | |
| 2012/0080939 | A1 | 4/2012 | Shimowake et al. | |
| 2012/0186872 | A1 | 7/2012 | Akuta | |

FOREIGN PATENT DOCUMENTS

JP 2008-098007 * 4/2008

* cited by examiner

*Primary Examiner* — Xuong Chung Trans

(74) *Attorney, Agent, or Firm* — Gerald E. Hespos; Michael J. Porco; Matthew T. Hespos

(57) ABSTRACT

A terminal block (10) is for connecting terminals (T) connected to enameled wires extending from a motor and busbars (B) extending from an inverter and includes a plurality of nuts (20) arranged in a width direction and configured to fasten the terminals (T) and the busbars (B) together with bolts (BT), guides (54) are provided between adjacent nuts (20) and configured to guide bolt fastening portions (T1) of the terminals (T) to the upper surfaces of the nuts by coming into contact with lateral edge parts of the terminals (T), and posture correcting portions (55) provided at positions where the terminals (T) are pulled out backward from the nuts and configured to correct postures of barrel portions (T2) of the terminals (T) in the width direction by contacting the barrels (T2) in the width direction.

8 Claims, 18 Drawing Sheets

TERMINAL BLOCK

BACKGROUND

1. Field of the Invention

The invention relates to a terminal block.

2. Description of the Related Art

Japanese Unexamined Patent Publication No. 2012-151038 discloses a terminal block for connecting motor-side busbars extending from a motor and inverter-side busbars extending from an inverter. More particularly, the motor-side busbars and the inverter-side busbars are placed one over the other on a plurality of nuts arranged in a width direction and bolts are inserted through both types of busbars and tightened to connect the busbars electrically.

A conductive member, such as a busbar, in the above-described terminal block may be displaced in the width direction when being placed on the nut or may be displaced rotationally in the width direction following rotation of the bolt as the bolt is tightened. Thus, the conductive member may be fixed in an improper posture. As a result, an insulation distance at which discharge does not occur may not be ensured.

The invention was completed in view of the above situation and an object thereof is to enable bolt tightening while maintaining an insulation distance between conductive members.

SUMMARY OF THE INVENTION

The invention relates to a terminal block for connecting conductive members extending from a device to mating conductive members. The terminal block includes at least one fastening seat configured to fasten the conductive members and the mating conductive members together with at least one bolt. At least one guide is provided adjacent to the fastening seat and is configured to guide the conductive member to the fastening seat by contacting a lateral edge of the conductive member. At least one posture correcting portion is provided at positions where the conductive member is pulled out to outside from the fastening seat and is configured to correct the posture of the conductive members in a width direction by contacting the conductive members pulled out to the outside from the fastening seat in the width direction. Accordingly, the conductive member can be guided to the fastening seat by the guide and the posture of the conductive member in the width direction can be corrected by the posture correcting portion when placing the conductive member on the fastening seat of the terminal block. In this way, it is possible to bolt the conductive member and the mating conductive member while ensuring an insulation distance between the conductive members.

Plural fastening seats preferably are arranged in the width direction and are configured to fasten the conductive members and the mating conductive members together with a plurality of bolts. The at least one guide preferably comprises between adjacent fastening seats.

The terminal block may comprise a bracket to be fixed to a case of the device.

The terminal block further may comprise an insulating plate arranged to be sandwiched by the nut and the bracket. The insulating plate preferably is made of a highly heat conductive synthetic resin containing glass or talc.

The terminal block may further comprise a resin portion that integrally fixes the nuts, the insulating plate and the bracket while holding them one over another in close contact by at least partly covering parts of these members.

A nut locking portion preferably is provided on the resin portion and locks a stepped portion of each nut together with the insulating plate from above. The nut locking portion locks the stepped portion of the nut to prevent a clearance from being formed between the nut and the insulating plate when the bolt is tightened with the nut.

The conductive member preferably includes a bolt fastening portion to be placed on the fastening seat in a mounting direction and a wire fixing portion to be fixed to an end of a wire.

The guides may project between adjacent bolt fastening portions. The posture correcting portions may stand up from the bracket to be arranged adjacent to and between the wire fixing portions. Accordingly, the guides guide bolt fastening portion onto the fastening seat while the posture correcting portions correct the posture of the wire fixing portion in the width direction when placing the conductive member on the fastening seat from above. Further, the disposition of the posture correcting portions between the wire fixing portions to which cores of the wires are to be fixed provides a large creepage distance (insulation distance) between the conductive members.

The posture correcting portion preferably is a plate extending in a pull-out direction in which the conductive member is pulled out.

A projection preferably is on an extending end of each posture correcting portion and projects in the width direction over the entire height of the posture correcting portion. The projection contacts the conductive member in the width direction when the conductive member is displaced with respect to the pull-out direction. The projection also strengthens the posture correcting portion. The conductive member contacts the projection in the width direction if the conductive member is displaced in the pull-out direction. As a result, the posture of the conductive member is corrected to approach a proper posture. Thus, the projection performs a reinforcing function and a posture correcting function, thereby simplifying the structure as compared with the case where a reinforcement and a posture correcting portion are provided separately on the posture correcting portion.

The posture correcting portions may meander in the width direction. The meandering configurations can improve the strength of the posture correcting portions and can suppress inclination of the posture correcting portions in the width direction when the conductive members contact the posture correcting portions or when other members contact the posture correcting portions as compared with the case where the posture correcting portions extend straight in the pull-out direction of the conductive members.

These and other objects, features and advantages of the invention will become more apparent upon reading the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

A first embodiment of the invention is illustrated in FIGS. 1 to 15 and includes a terminal block 10 that is to be mounted to a mounting device such as a motor case (not shown) made of conductive material (e.g. metal) and installed in a vehicle such as an electric vehicle or a hybrid vehicle. The terminal block 10 electrically connects terminals T and busbars B. The terminals T are connected to enameled wires (not shown) extending from a connection device, e.g. extending from a three-phase AC motor housed in the motor case. The busbars B extend from the connection device, e.g. from an inverter. Note that, in the following description, a vertical direction is based on that in FIG. 2, forward and backward directions are based on a vertical direction of FIG. 9, and a side where the busbars B are arranged (shown upper side) is referred to as a front side.

Figure 10:
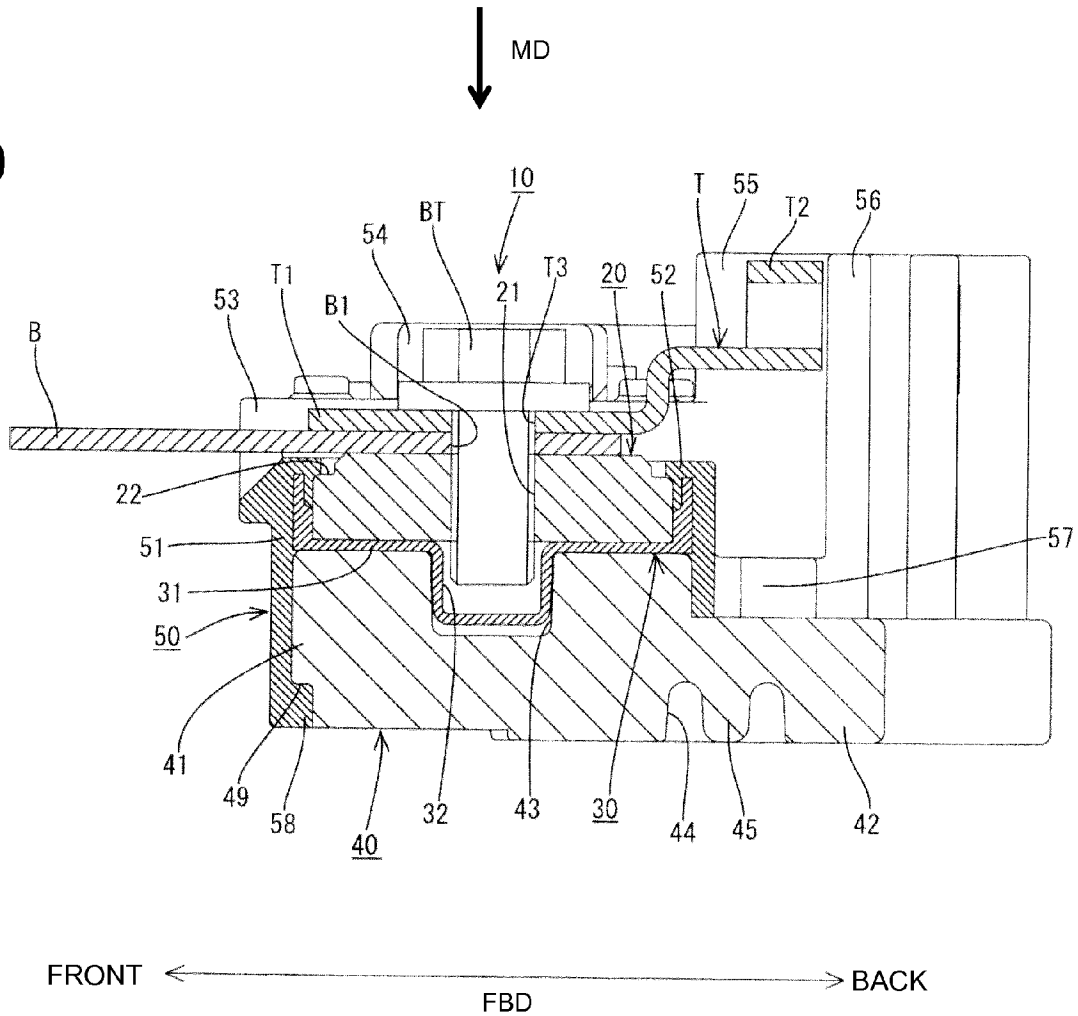
FIG. 10 is a section along X-X of FIG. 9.
Figure 11:
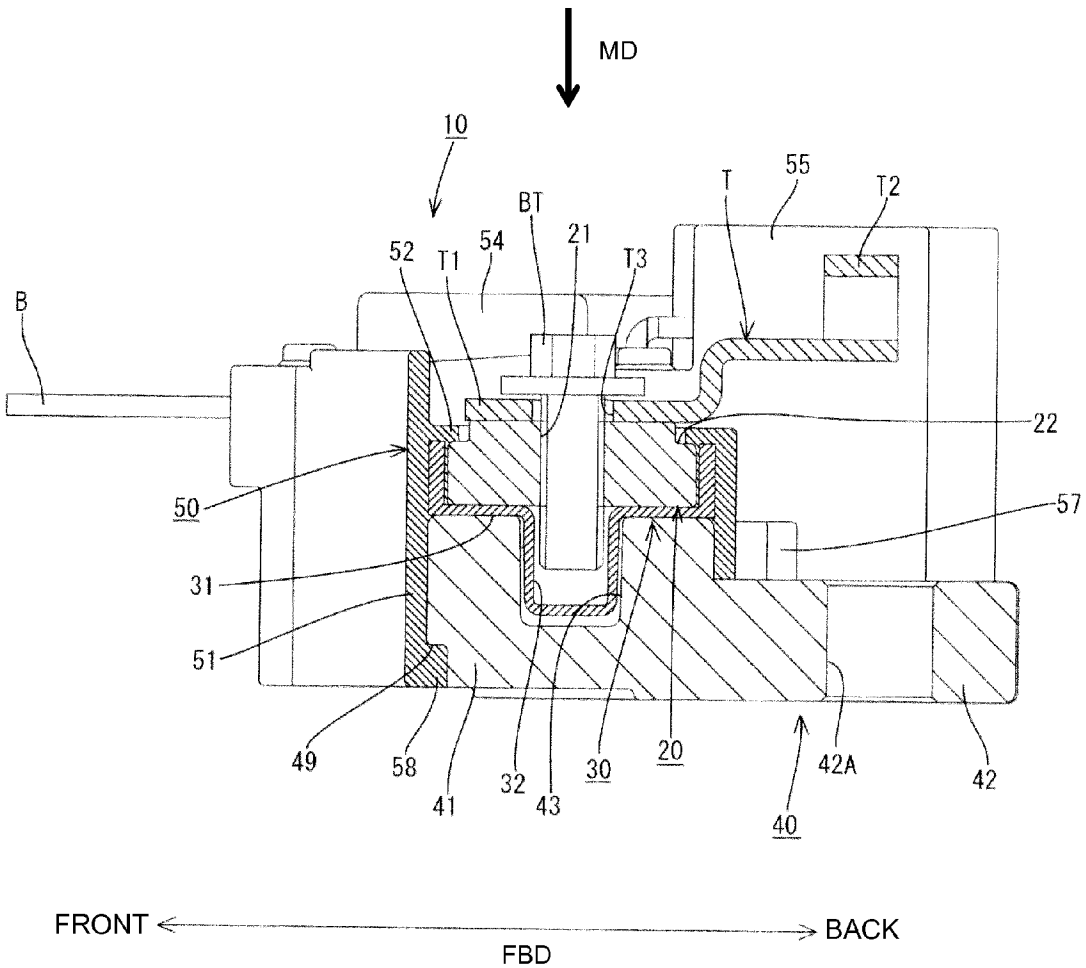
FIG. 11 is a section along XI-XI of FIG. 9.
Figure 12:
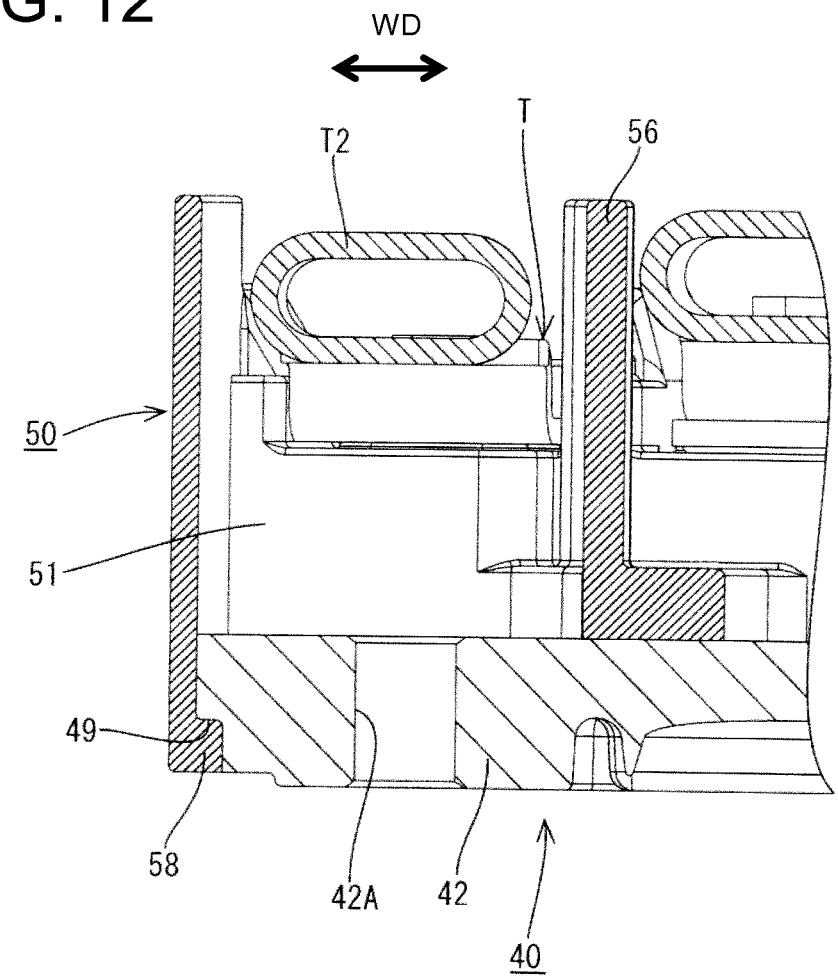
FIG. 12 is a section along XII-XII of FIG. 9.

As shown in FIGS. 10 and 11, the terminal block 10 has nuts 20 on which the busbars B and the terminals T are to be placed in a mounting direction MD (e.g. from above), a bracket 40 below the nuts 20, an insulating plate 30 between the nuts 20 and the bracket 40, and a resin portion 50 for integrally fixing these.

The busbar B is a substantially flat plate that vertically penetrates the bolt insertion hole B1 in the mounting direction MD at a position to be placed on the nut 20.

Figure 8:
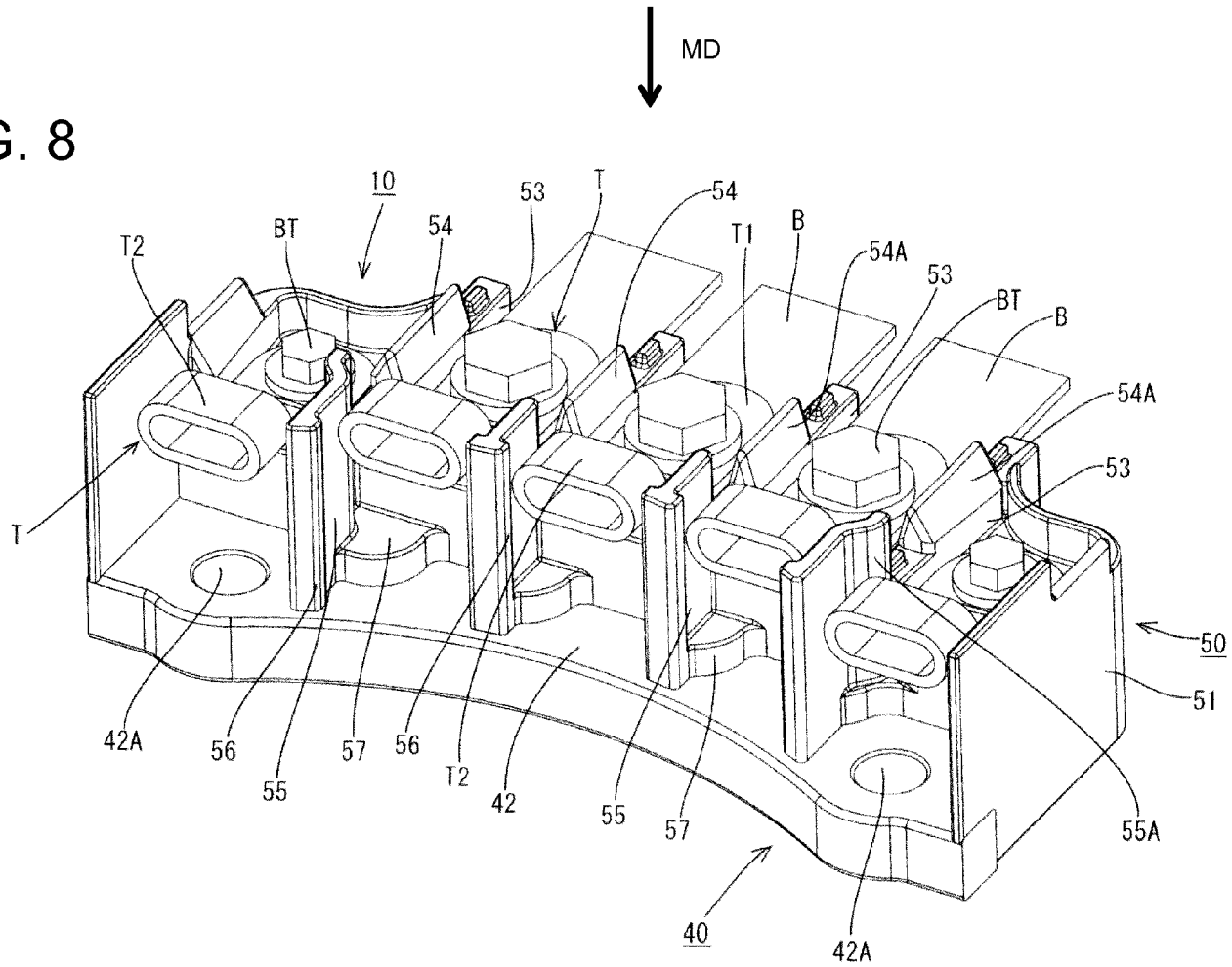
FIG. 8 is a perspective view showing a state where busbars and terminals are bolted in proper postures.
Figure 9:
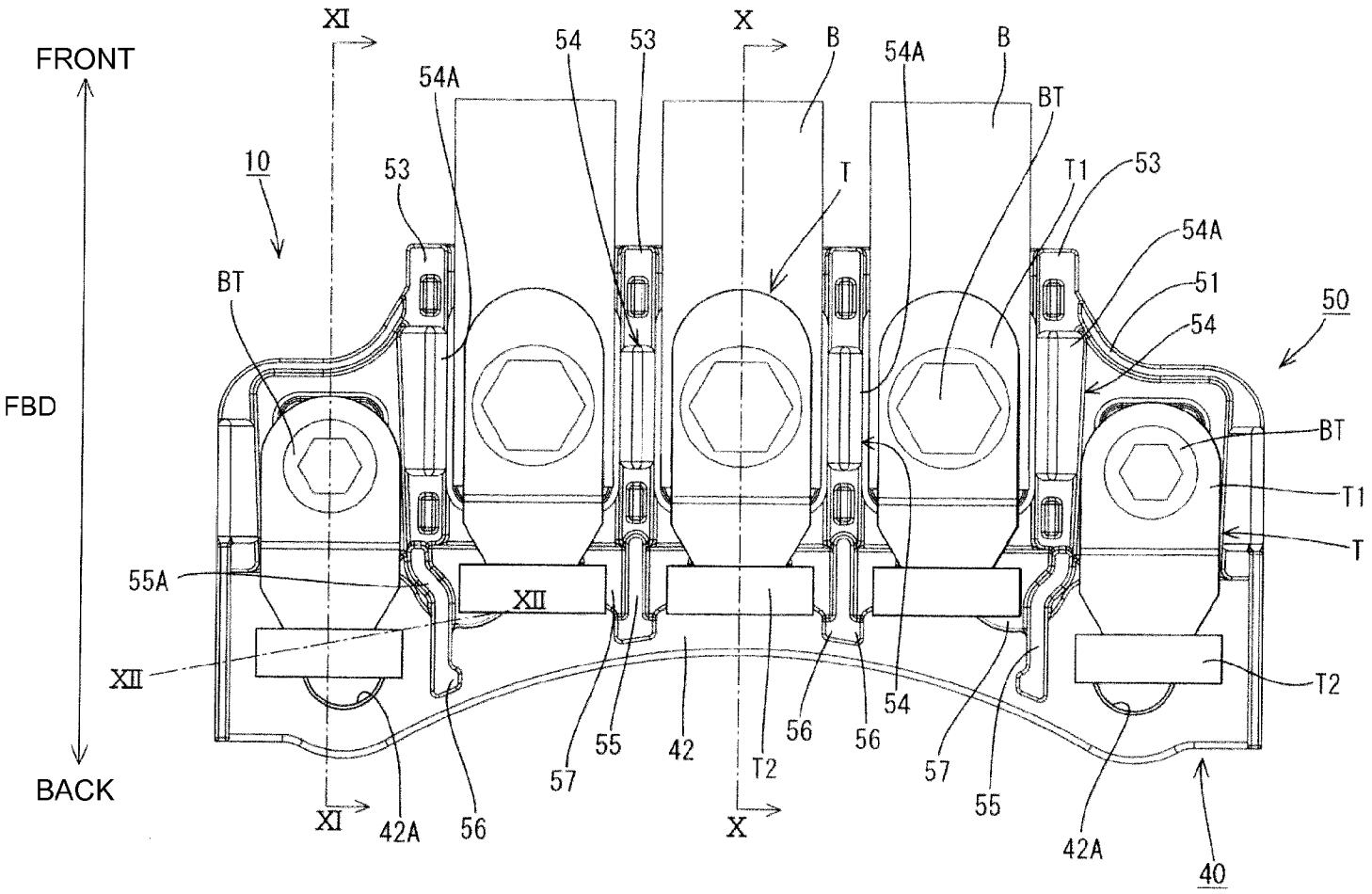
FIG. 9 is a plan view showing the state of FIG. 8.

As shown in FIGS. 8 to 10, the terminal T includes a bolt fastening portion T1 in the form of a flat plate to be placed on the nut 20 and a barrel T2 to which enameled wires are to be connected. A connecting part is between the bolt fastening portion T1 and the barrel T2 and is cranked so that the barrel T2 is offset from the bolt fastening portion T1. The bolt fastening portion T1 is formed with a vertically penetrating bolt insertion hole T3. Further, the barrel T2 particularly is in the form of a substantially elliptical tube that is wide in the width direction WD, and substantially opposite widthwise end parts are rounded.

Figure 3:
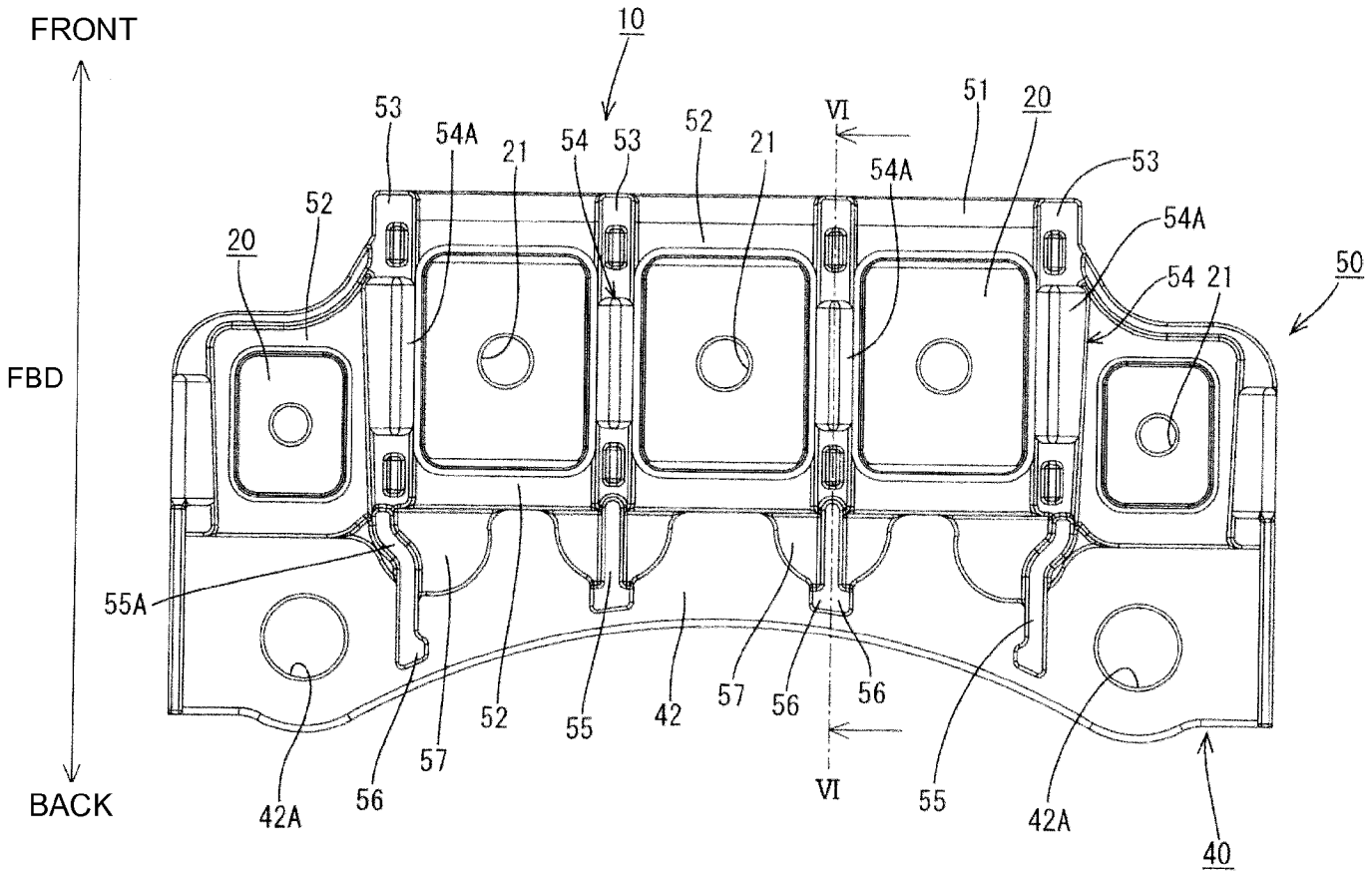
FIG. 3 is a plan view of the terminal block.

Each nut 20 is made of conductive material such as metal and, as shown in FIG. 3, has a substantially rectangular plan view. A bolt fastening hole 21 is provided in a central part of each nut 20 and a bolt BT can be tightened therein. The nuts 20 are arranged in the width direction WD. The bolt fastening portion T1 of the terminal T for power source and the busbar B are placed one over the other on each of the three middle nuts 20. The bolt BT is inserted through the bolt fastening hole T3 of the bolt fastening portion T1 and the bolt insertion hole B1 of the busbar B and tightened into the bolt fastening hole 21 of the nut 20 so that the terminal T and the busbar B are fastened together and electrically connected by the bolt BT and the nut 20, as shown in FIG. 10.

The bolt fastening portion T1 of the terminal T for neutral point is placed on each of the nuts 20 on the opposite sides from above, the bolt BT is inserted through the bolt insertion hole T3 of the bolt fastening portion T1 and tightened into the bolt fastening hole 21 of the nut 20 so that the terminal T for neutral point is bolted to the nut 20 as shown in FIG. 11.

The barrel T2 of the terminal T is behind or offset from the nut 20 when the bolt fastening portion T1 of each terminal T is fixed to the nut 20.

A step 22 is formed over substantially the entire periphery on an upper peripheral edge of each nut 20. As shown in FIGS. 10 and 11, this step 22 is slightly lower than the upper surface of the nut 20 and is covered at least partly by a nut locking portion 52 of the resin 50 from above.

The insulating plate 30 is made of a highly heat conductive synthetic resin containing glass or talc and is sandwiched vertically by the nuts 20 and the bracket 40, as shown in FIGS. 10 and 11. A bottom plate 31 is arranged between the nuts 20 and the bracket 40 and is in the form of a thin flat plate. The lower surfaces of the nuts 20 are held in close contact with the upper surface of the bottom plate 31, and the upper surface of the bracket 40 is held in close contact with the lower surface of the bottom plate 31. Thus, heat of the nuts 20 is transferred efficiently to the bracket 40 via the insulating plate 30.

The bottom plate 31 of the insulating plate 30 has bolt escaping recesses 32, which are bottomed recesses that project down. Each bolt escaping recess 32 substantially corresponds to the bolt fastening hole 21 of the nut 20 arranged on the upper surface of the insulating plate 30, and prevents interference of the bolt BT and the insulating plate 30 by allowing the tip of the bolt BT to escape when the bolt BT is tightened into the nut 20.

Figure 14:
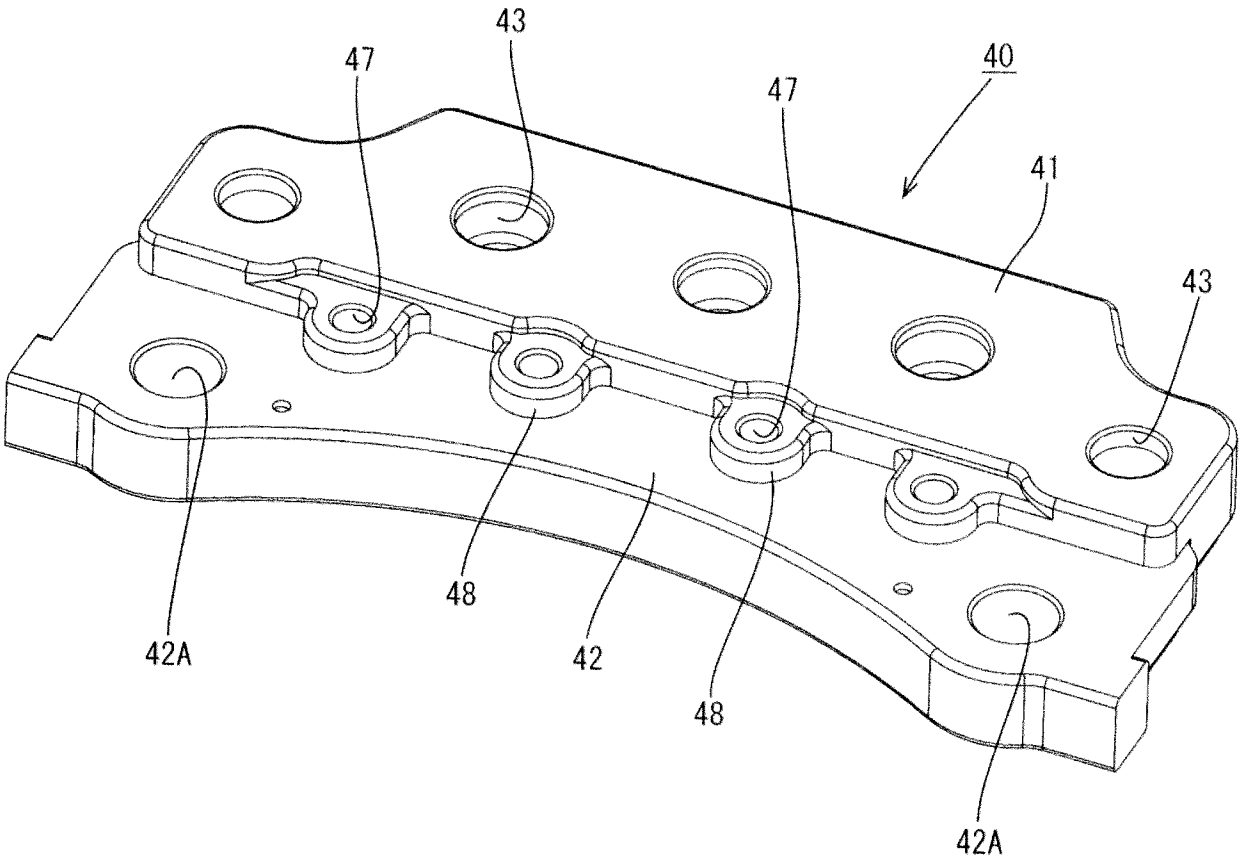
FIG. 14 is a perspective view of a bracket.
Figure 15:
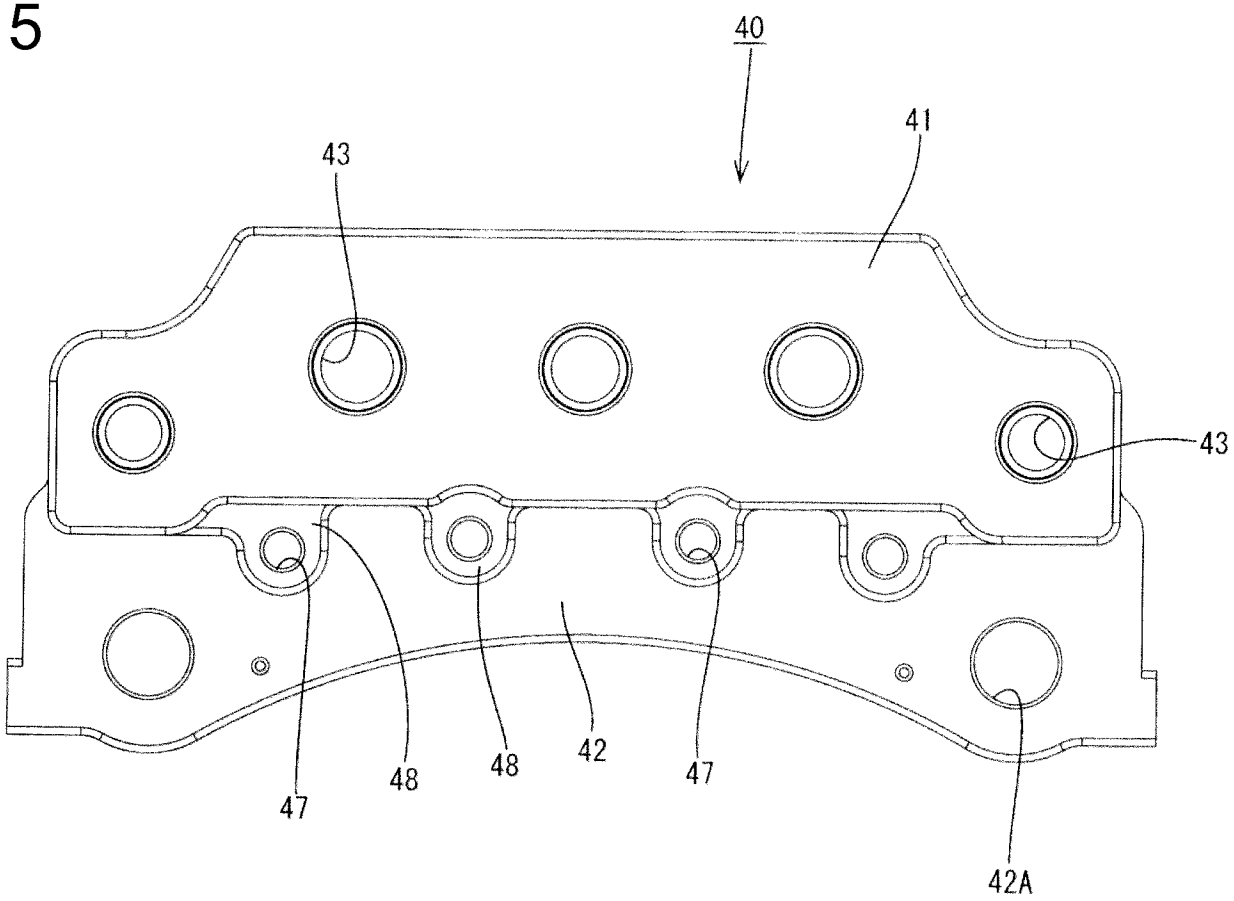
FIG. 15 is a plan view of the bracket.

The bracket 40 is formed by aluminum die casting and, as shown in FIGS. 14 and 15, wide in the width direction WD. The rear surface of the bracket 40 is formed into a substantially arcuate or bent shape substantially in conformity with the shape of the motor case. As shown in FIGS. 10 and 11, the bracket 40 includes an embedded portion 41 on which the insulating plate 30 is to be placed and that is covered by the resin 50. A mounting portion 42 is connected behind the embedded portion 41 and is exposed from the resin portion 50.

The insulating plate 30 is placed on the upper or outer surface of the embedded portion 41 and covers substantially the entire upper surface of the embedded portion 41. Fitting recesses 43 are provided substantially side by side in the width direction WD on the upper surface of the embedded portion 41 and receive the bolt escaping recesses 32 of the insulating plate 30. The insulating plate 30 is to be mounted on the upper surface of the embedded portion 41 without being displaced by fitting the bolt escaping recesses 32 into the fitting recesses 43.

As shown in FIGS. 10 and 15, the mounting portion 42 is provided on a lower rear end edge of the embedded portion 41 and is to be fixed to an attaching portion (not shown) on the motor case. As shown in FIG. 3, through holes 42A vertically penetrate opposite widthwise sides of the mounting portion 42. Fixing bolts (not shown) are inserted through the through holes 42A and tightened into the attaching portion to fix the bracket 40 and the terminal block 10 to the motor case.

Figure 5:
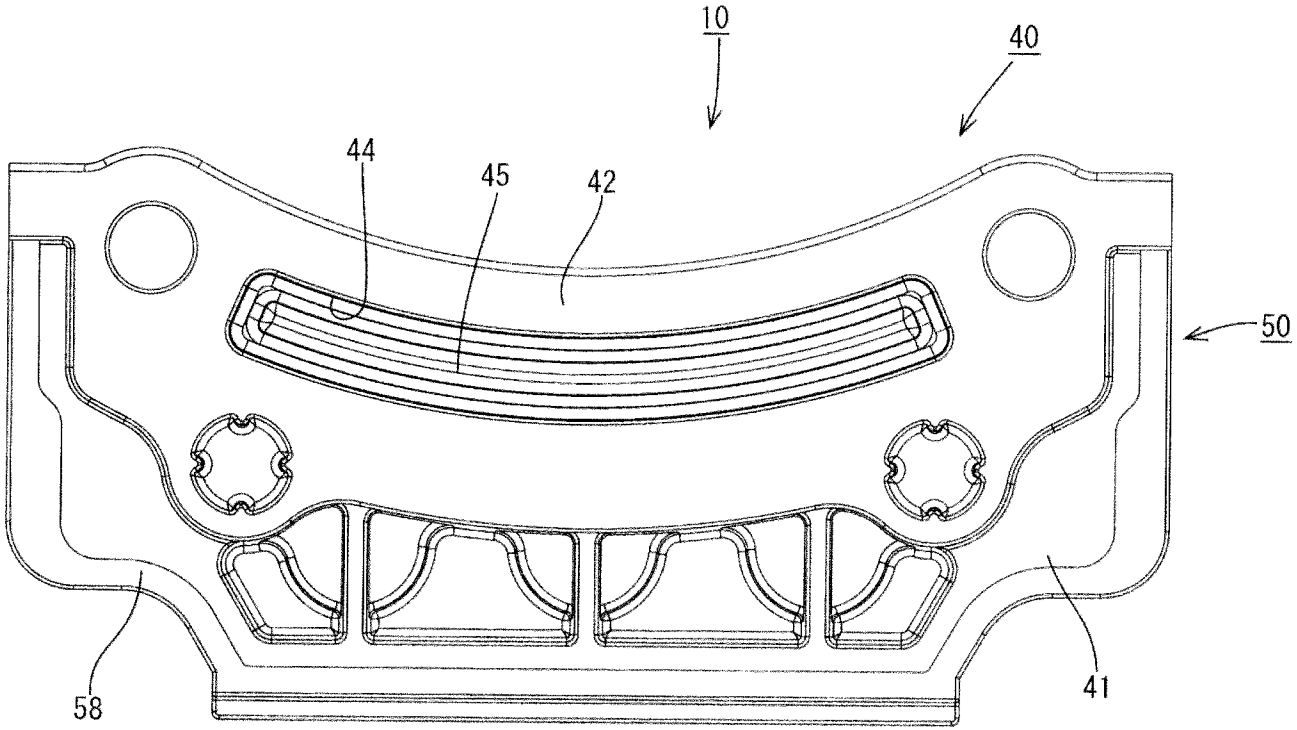
FIG. 5 is a bottom view of the terminal block.
Figure 6:
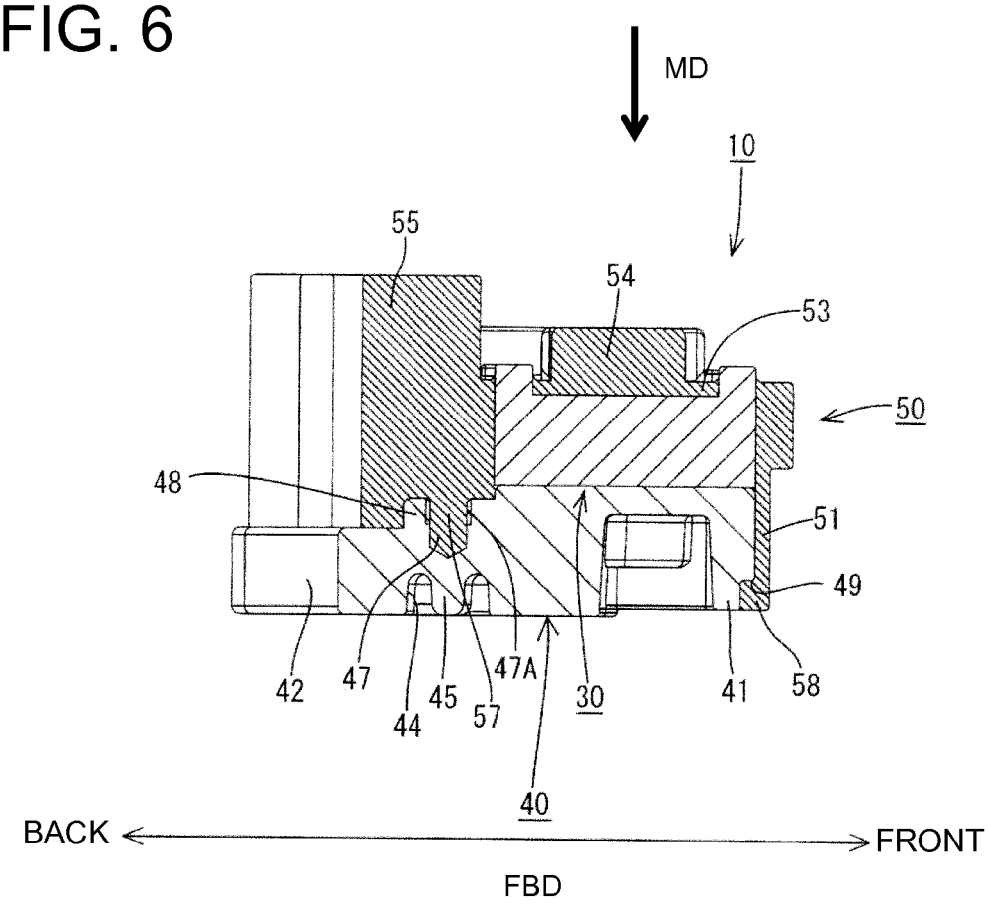
FIG. 6 is a section along VI-VI of FIG. 3.

As shown in FIGS. 5 and 6, at least one arcuate heat radiation recess 44 is formed on the lower surface of the mounting portion 42 and extends in the width direction WD. The heat radiation recess 44 is recessed up and at least one cooling fin 45 projects down near the back wall of the heat radiation recess 44. When the mounting portion 42 is fixed to the attaching portion of the motor case, coolant circulating in the motor case can circulate substantially in the width direction WD in the heat radiation recess 44 and heat of the bracket 40 is efficiently radiated from the cooling fin 45.

The resin portion 50 is made of synthetic resin and, as shown in FIGS. 10 and 11, integrally fixes the nuts 20, the insulating plate 30 and the bracket 40 while vertically holding them one over another in close contact by at least partly covering parts of these members. The resin portion 50 includes a main body 51 that collectively covers side surfaces of the nuts 20, of the insulating plate 30 and of the embedded portion 41.

A substantially rectangular nut locking portion 52 is provided on an upper part of the main body 51 and locks the step 22 of each nut 20 together with the insulating plate 30. The nut locking portion 52 locks the step 22 of each nut 20 from above to prevent a clearance from being formed between the nut 20 and the insulating plate 30 when the bolt BT is tightened into the bolt fastening hole 21 of the nut 20 and the nut 20 is pulled up.

Figure 4:
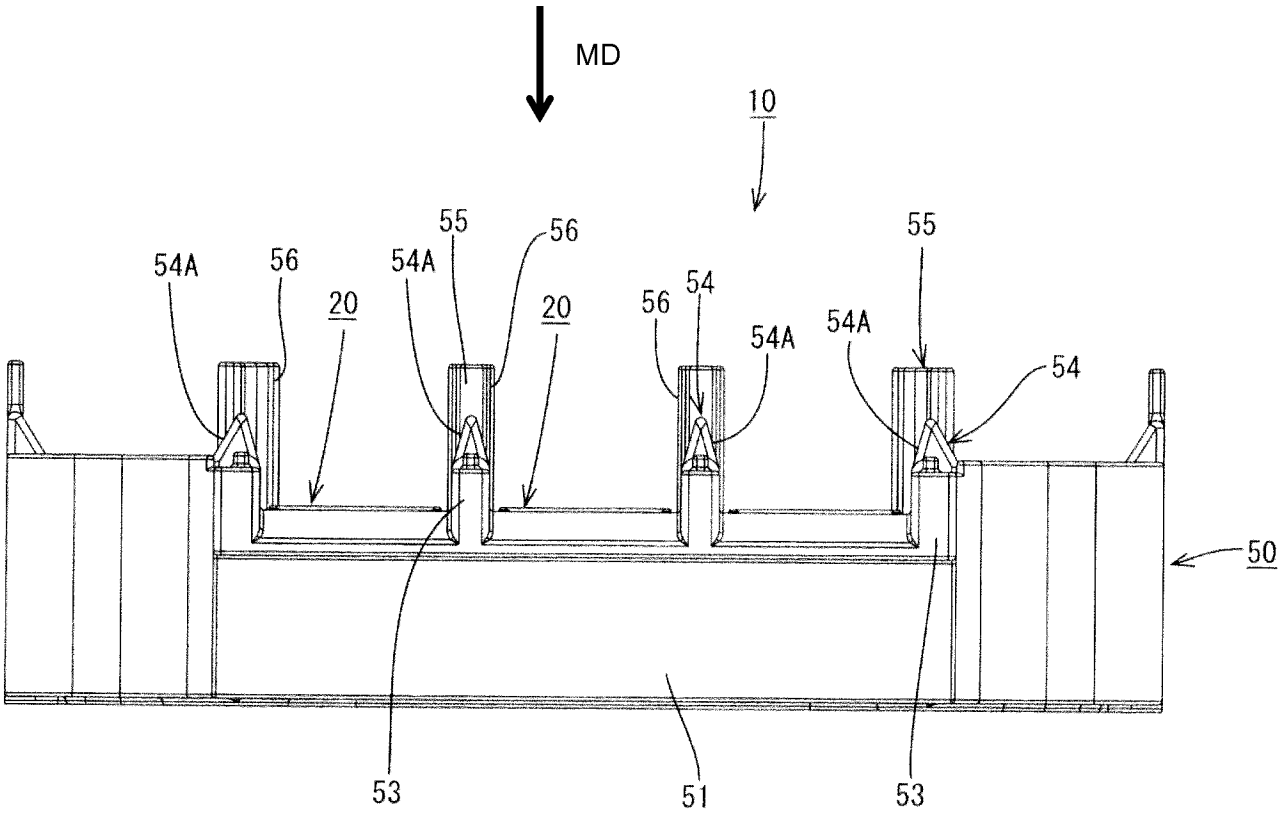
FIG. 4 is a rear view of the terminal block.

As shown in FIGS. 3 and 4, partition walls 53 stand up from the main body 51 at positions between adjacent nut locking portions 52 and partition adjacent nuts 20. Specifically, the partition walls 53 are arranged substantially side by side in the width direction WD and extend over the entire length of the main body portion 51 in forward and backward directions FBD. The height of the partition wall 53 exceeds the sum of the thickness of the bolt fastening portion T1 of the terminal T and the thickness of the busbar B placed on the nut 20, as shown in FIG. 10. Thus, a distance at which insulation is maintained between adjacent bolt fastening portions T1 and between adjacent busbars B is assured, i.e. a so-called insulation distance (creepage distance).

A guide 54 is provided of an upper end of each partition wall 53 at an intermediate part in forward and backward directions FBD, as shown in FIGS. 3 and 4, and guides the busbar B and the terminal T with respect to the upper surface of the nut 20. The guide 54 has a converging or pointed triangular shape that is long in forward and backward directions FBD and has oblique surfaces 54A on opposite widthwise sides. Thus, the busbar B and the bolt fastening portion T1 contact the oblique surfaces 54A of the guides 54 and are guided onto the upper surface of the nut 20 even if the busbar B and/or the bolt fastening portion T1 of the terminal T are displaced slightly in the width direction WD when placing the busbar B and the terminal T on the upper surface of the nut 20 in the mounting direction MD.

Figure 1:
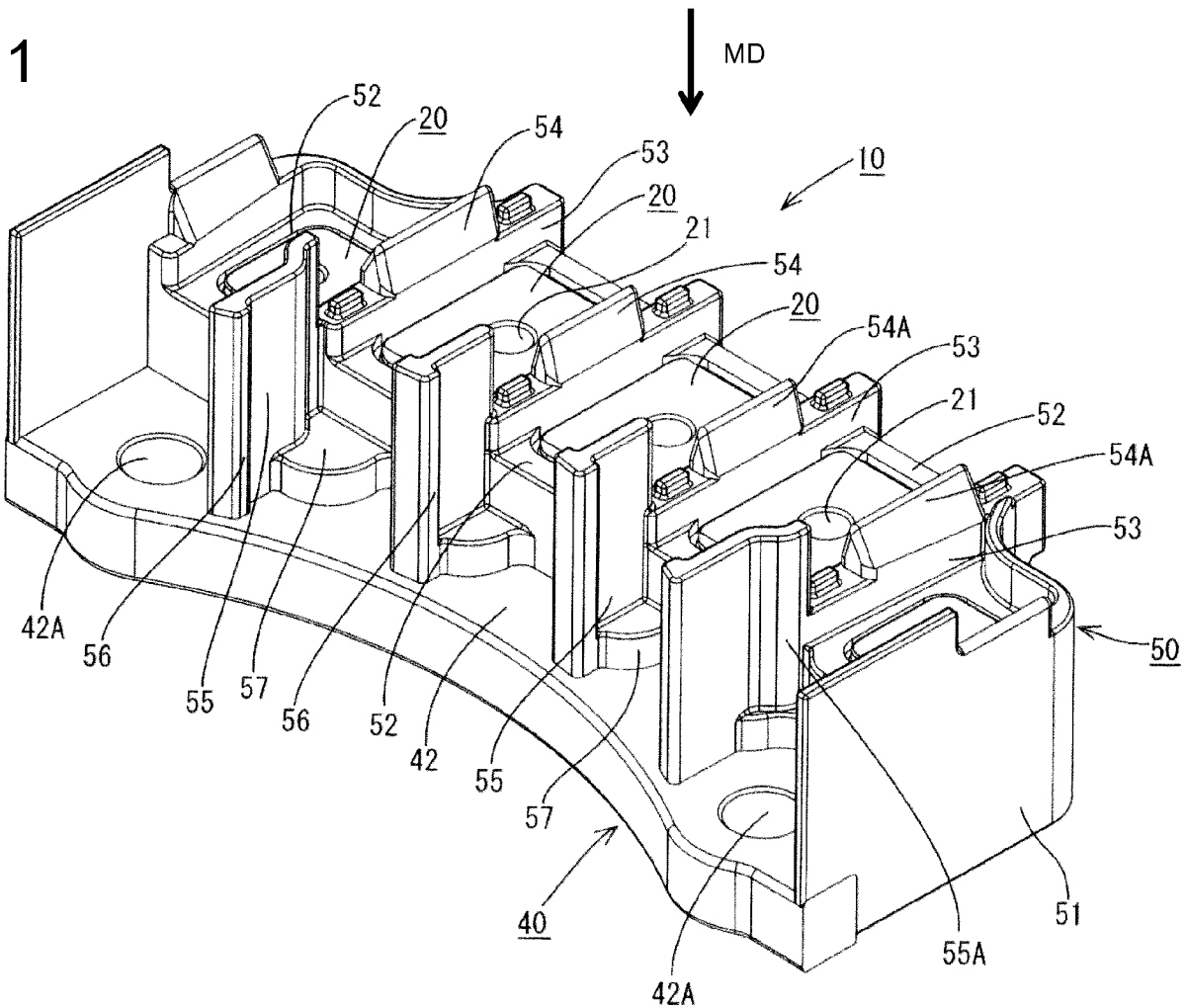
FIG. 1 is a perspective view of a terminal block in a first embodiment.
Figure 2:
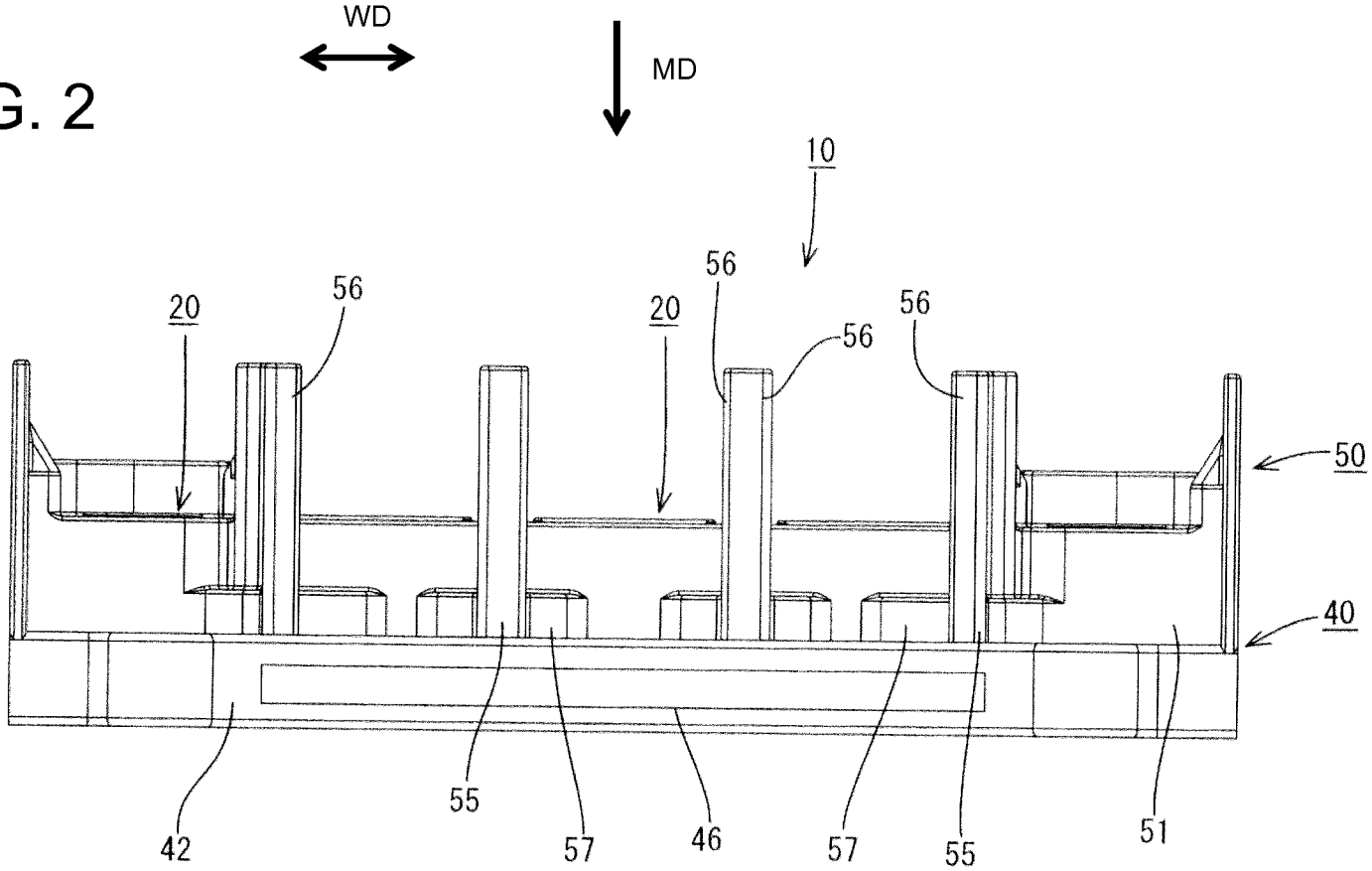
FIG. 2 is a front view of the terminal block.

As shown in FIGS. 1 and 3, a substantially plate-like posture correcting portion 55 extends back from the rear end of each partition wall 53. The posture correcting portions 55 project up along the mounting direction MD from the upper surface of the mounting portion 42. The posture correcting portions 55 on opposite widthwise sides meander in the width direction WD at positions near the partition walls 53 as shown in FIG. 3, thereby forming crank portions 55A bent toward the center.

As shown in FIG. 9, the barrels T2 of the terminals T placed on the nuts 20 are arranged at opposite widthwise sides of the posture correcting portions 55 with clearances defined in the width direction WD therebetween. As shown in FIGS. 10 and 11, the height of the posture correcting portion 55 exceeds the height of the barrel T2 located on a rear part of the terminal T, and a rear end part thereof extends more backward than the rear part of the barrel T2. When the terminals T are placed on the nuts 20, the posture correcting portions 55 block between the barrels T2 of adjacent terminals T to ensure a creepage distance (insulation distance) between adjacent barrels T2.

Figure 13:
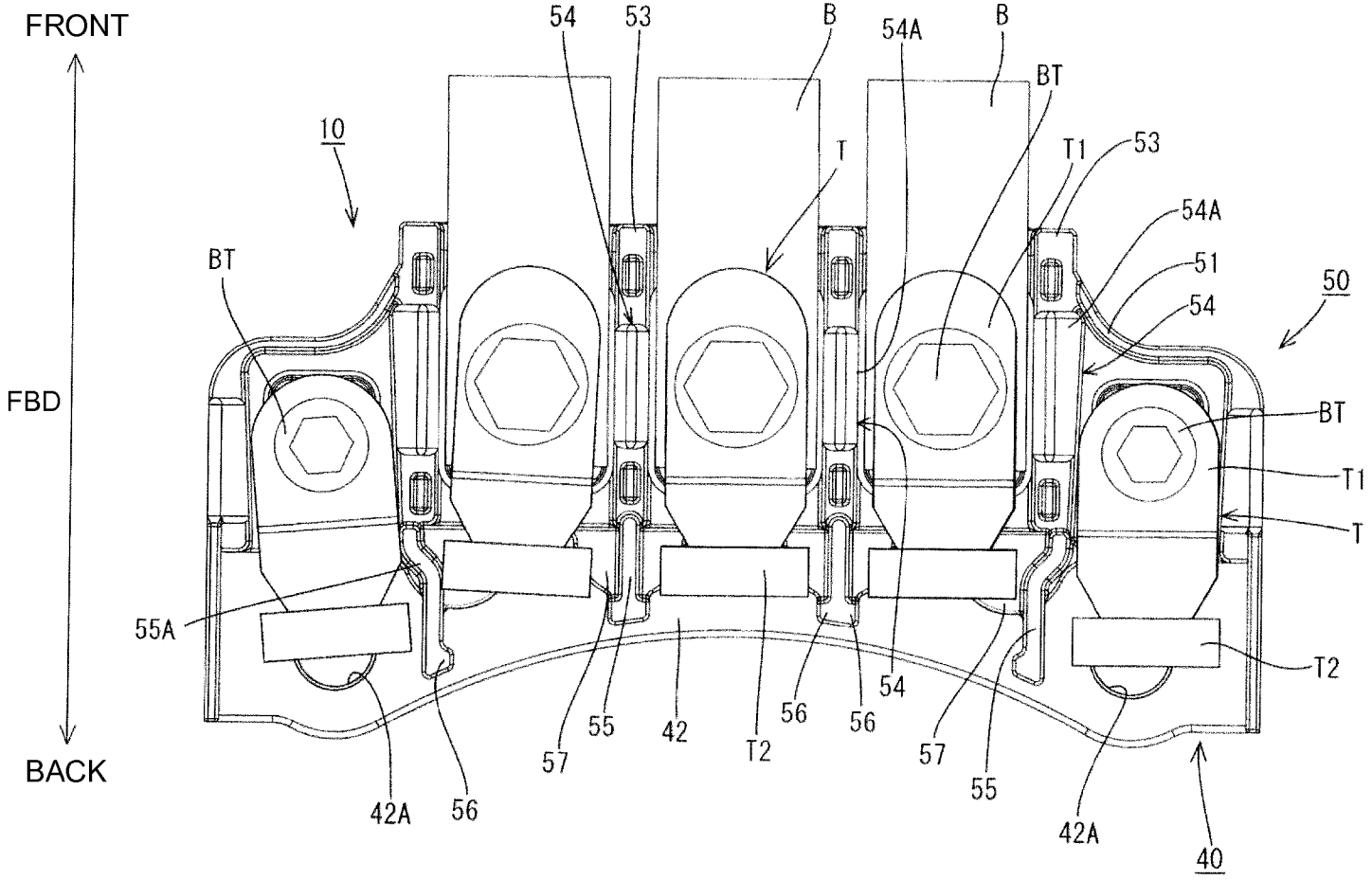
FIG. 13 is a perspective view showing a state where the busbar and the rotated terminal are bolted.

Further, if the terminal T is placed on the nut 20 from above and in the mounting direction MD with the barrel T2 thereof displaced in the width direction WD, the posture correcting portion 55 contacts a lateral edge of the barrel T2 in the width direction and corrects the posture of the barrel T2 in the width direction WD to a substantially proper posture in which the terminal T is straight in forward and backward directions FBD. When the terminals T are placed on the nuts 20, the adjacent barrel portions T2 are blocked by the posture correcting portions 55 and the creepage distance (insulation distance) between the barrels T2 is ensured even if the adjacent barrels T2 are displaced slightly in the width direction WD, as shown in FIG. 13.

The terminal T may rotate following the rotation of the bolt BT when tightening the bolt BT into the nut 20. However, the posture correcting portion 55 contacts the barrel T2 in the width direction WD to limit rotation of the terminal T and ensuring the creepage distance (insulation distance) between the adjacent barrels T2.

At least one projection 56 project substantially in the width direction WD on a rear end part of each posture correcting portion 55 for reinforcement. The projection 56 is formed over the entire height of the posture correcting portion 55 and is behind the barrel T2 of the terminal T mounted in a proper posture on the nut 20.

Projections 56 is provided on each of opposite widthwise sides of each of the two posture correcting portions 55 arranged in the intermediate position out of the posture correcting portions 55 to prevent the posture correcting portion 55 from being inclined in the width direction WD and broken when a lateral force acts on the posture correcting portion 55. Further, one projection 56 is provided on each of the two posture correcting portions 55 arranged on opposite widthwise sides and projects toward the center to cooperate with the crank portion 55A to reinforce the posture correcting portion 55. Thus, the two posture correcting portions 55 arranged on the opposite widthwise sides prevent the posture correcting portions 55 from being inclined in the width direction WD to be broken when a lateral force acts on the posture correcting portions 55.

The strength of the posture correcting portion in the width direction WD could be increased by setting the thickness of the entire posture correcting portion to the thickness of the part where the projecting portions are provided. However, if the thickness of the entire posture correcting portion is increased, the clearance between the posture correcting portion and the barrel becomes smaller. Even a slight displacement of the terminal T in the width direction WD may cause the barrel T2 to move onto the posture correcting portion when placing the nut 20 on the terminal T. However, the clearance between the posture correcting portion 55 and the barrel T2 is made larger by thinning the posture correcting portion 55 except at the part where the projections 56. Thus the barrel T2 easily can be arranged between the posture correcting portions 55 even if the terminal T is displaced slightly in the width direction WD when being placed on the nut 20. This can improve mounting operability in placing the terminal T on the nut 20.

The creepage distance between the barrels of adjacent terminals T may become shorter if the bolt insertion hole T3 of the bolt fastening portion T1 is large relative to the bolt BT and the terminal T is bolted in a state slightly displaced backward. However, if the terminal T is displaced backward, the projecting portions 56 contact the barrel T2 in the width direction WD and the posture of the terminal T can be corrected to approach a proper posture where the terminal T is substantially straight in forward and backward directions FBD. Thus, the required creepage distance (insulation distance) between the barrels T2 is assured.

The projection 56 has two functions, namely, reinforcing the posture correcting portion 55 and correcting the posture of the terminal T. Thus, the structure of the posture correcting portion 55 becomes less complicated, as compared with the case where the reinforcing function and the posture correcting function are provide separately.

A first lock 57 is provided on a lower end part of the posture correcting portion 55 and engages a bottomed screw hole 47 provided on the mounting portion 42.

The screw hole 47 of the mounting portion 42 has a screw groove 47A on the inner peripheral surface and is formed by recessing the upper surface of a substantially cylindrical build-up portion 48 projecting from the upper surface of the mounting portion 42.

Figure 7:
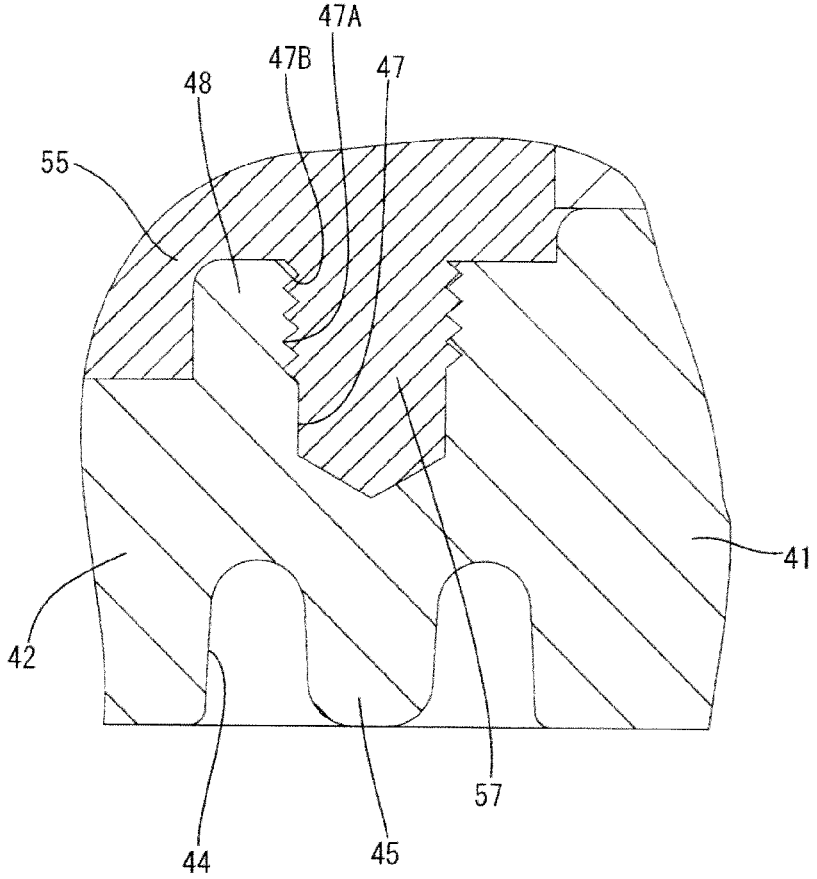
FIG. 7 is an enlarged section of an essential part of FIG. 6.

As shown in FIG. 7, the first lock 57 enters the screw hole 47 of the mounting portion 42 and the screw groove 47A of the screw hole 47 by covering the build-up portion 48 of the mounting portion 42. The first lock 57 locks an upper end 47B of the screw groove 47A from below when an upward pulling force acts on the resin portion 50. Thus, the main body 51 of the resin portion 50 and the embedded portion 41 of the bracket 40 cannot be separated at a rear end of the resin portion 50 when the bolt BT is tightened into the bolt fastening hole 21 of the nut 20 and the resin portion 50 is pulled up together with the nut 20.

Further, the first locking portions 57 and the screw holes 47 particularly are arranged substantially between adjacent nut locking portions 52, and two nut locking portions 52 are supported by one first locking portion 57 and one screw hole 47. That is, e.g. five nut locking portions 52 are supported by four first locking portions 57 and e.g. four screw holes 47 on the rear end side of the resin portion 50 and the numbers of the first locking portions 57 and the screw holes 47 can be reduced as compared with the case where the first locking portion is formed for each nut locking portion. This can prevent the bracket 40 and the resin portion 50 from being separated while simplifying the structure of the rear end side of the resin portion 50.

The screw holes 47 are arranged in correspondence with and above the heat radiation recess 44 of the mounting portion 42 and formed in the build-up portions 48 on top of the mounting portion 42 so that a sufficient thickness is ensured between the heat radiation recess 44 and the screw holes 47.

Although a screw hole is formed by cutting using a drill or the like, it is generally not possible to form a screw groove with a tip part of the drill. Hence, the depth of the screw hole is larger than the height of a part where the screw groove is provided. Thus, if it is attempted to form a screw hole with a predetermined dimension of a screw groove ensured above a heat radiation recess without providing a build-up portion on a mounting portion, a sufficient thickness cannot be ensured between the heat radiation recess and the screw hole and the screw hole cannot be provided above the heat radiation recess. However, the screw hole 47 is formed in the build-up portion 48 provided on top of the mounting portion 42. Thus, the heat radiation recess 44 and the screw hole 47 can be formed vertically one above the other on the mounting portion 42 while ensuring a sufficient thickness between the heat radiation recess 44 and the screw hole 47. Thus, the mounting portion 42 is not enlarged as compared with the case where the mounting portion and the heat radiation recess are displaced in forward and backward directions.

On the other hand, as shown in FIGS. 6, 10 and 11, a second locking portion 58 is provided on a lower end part of the main body 51 for locking an engaging portion 49 connected to a lower outer peripheral edge part of the embedded portion 41 and opposite lower lateral edges of the mounting portion 42 from below.

The engaging portion 49 is stepped to be raised slightly from the lower surface of the bracket 40 and is recessed slightly inward of the outer peripheral surfaces of the embedded portion 41 and the mounting portion 42.

The second locking portion 58 is formed on an outer peripheral edge of the main body portion 51 except at a front edge part of the main body 51 to correspond to the engaging portion 49, and at least partly covers the engaging portion 49 from below. That is, as shown in FIG. 5, the second locking portion 58 is substantially U-shaped in bottom view and surrounds the embedded portion 41 over substantially the entire circumference together with the first locking portions 57 of the main body portion 51.

Specifically, the first and second locking portions 57, 58 of the main body 51 lock the bracket 40 from below in such a manner as to surround the embedded portion 41 over substantially the entire circumference and reliably prevent the resin portion 50 and the bracket 40 from being separated vertically.

To prevent the separation of a resin portion and a bracket, it is thought to provide a stepped engaging portion over the entire circumference on a lower outer peripheral edge part of the bracket and lock the engaging portion over the entire circumference from below by a locking portion of a main body portion by covering the side surfaces of the bracket and the engaging portion over the entire circumference by the resin portion. However, a heat radiation property of the bracket may be reduced if the outer peripheral surface of the bracket is covered over the entire circumference with resin. Further, a gate mark 46 formed when the bracket 40 is formed by die casting may be left on the rear surface of the mounting portion 42. If that gate mark 46 is covered with resin, the resin portion may be broken, such as due to the formation of cracks from fine edge parts formed on an outer peripheral edge part of the gate mark 46.

However, the mounting portion 42 is exposed from the resin portion 50 according to this embodiment. Thus, the resin portion 50 will not break while a heat radiation property of the bracket 40 is improved.

The busbars B extending from the connection device (such as the inverter) are placed on the upper surfaces (mounting surfaces) of the nuts 20 of the terminal block 10 mounted and fixed to the mounting device (such as the motor case) and, then, the terminals T connected to ends of the enameled wires extending from the mounting device (particularly the motor) are placed on the busbars B.

The busbars B may be displaced slightly in the width direction WD when the busbars B are placed on the nuts 20 from above and in the mounting direction MD. However, the lateral edges of the busbars B contact the oblique surfaces 54A of the guides 54 and the busbars B are guided and placed onto the upper surfaces of the nuts 20. Further, even if the terminals T are displaced slightly in the width direction WD, the lateral edges of the bolt fastening portions T1 of the terminals T contact the oblique surfaces 54A of the guiding portions 54 and the terminals T are guided and placed onto the upper surfaces of the nuts 20 similarly to the busbars B.

Further, in the case of the terminal T, even if the barrel T2 is displaced in the width direction WD due to rotational displacement of the terminal T in the width direction WD, the posture correcting portion 55 contacts the lateral edge of the barrel T2 in the width direction WD so that the posture of the barrel portion T2 in the width direction WD is corrected and the terminal T is placed on the nut 20 in a state where adjacent barrels T2 are blocked by the posture correcting portion 55.

The busbar B and the terminal T can be guided onto the nut 20 by the guiding portion 54 and the posture of the barrel T2 of the terminal T can be corrected by the posture correcting portion 55 when the busbar B and the terminal T are placed on the nut 20. Thus, the terminal T and the busbar B can be placed on the nut 20 while ensuring the creepage distance (insulation distance) between adjacent barrel portions T2.

The posture correcting portion 55 corrects the posture of the terminal T by contacting the barrel T2 of the terminal T, and it is necessary to prevent the posture correcting portion 55 from being inclined in the width direction WD to be broken. It is thought to increase the thickness of the entire posture correcting portion to prevent the inclination of the posture correcting portion. However, if the thickness of the posture correcting portion is increased, the clearance between the posture correcting portion and the barrel becomes smaller and even only a slight displacement of the terminal T in the width direction WD may cause the terminal T to move onto the posture correcting portion, so that operability in mounting the terminal T on the nut 20 is reduced.

However, the projections 56 are provided only on the rear part of each posture correcting portion 55 and a part of the posture correcting portion 55 where the barrel T2 is arranged is thinner. Thus, the barrel T2 easily can be arranged between adjacent posture correcting portions 55 even if the barrel T2 is displaced slightly in the width direction WD. This can improve operability in mounting the terminal T on the nut 20 while ensuring the strength of the posture correcting portion 55 in the width direction WD, as compared with the case where the thickness of the entire posture correcting portion is increased.

The bolt BT then is inserted through the busbar B and the bolt insertion hole T3 of the bolt fastening portion T1 and tightened into the bolt fastening hole 21 of the nut 20.

The terminal T may try to rotate with the bolt BT when tightening the bolt BT into the nut 20. However, the posture correcting portion 55 contacts the barrel T2 in the width direction WD to prevent the terminal T from rotating.

Further, in case of plural terminals T, a distance between adjacent terminals T may become shorter and the creepage distance (insulation distance) cannot be ensured if the bolt insertion hole T3 of the bolt fastening portion T1 is large relative to the bolt BT and the terminal T is displaced slightly backward. However, the projecting portions 56 contact the barrel T2 in the width direction WD and the posture of the terminal T can be corrected to approach the proper posture in which the terminal T is straight in forward and backward directions FBD if the terminal T is displaced backward. This can reliably ensure the creepage distance (insulation distance) between the barrels T2.

When the bolt BT is tightened completely into the bolt fastening hole 21 of the nut 20, the busbar B and the bolt fastening portion T1 are fastened together and electrically connected by the bolt BT and the nut 20.

In the process of tightening the bolt BT into the nut 20, the resin portion 50 is pulled up together with the nut 20 and the bracket 40 fixed to the mounting device (e.g. the motor case) and the resin portion 50 may be separated. However, the first locking portions 57 lock the upper ends 47B of the screw grooves 47A in the screw holes 47 provided on the mounting portion 42 from below on the rear edge of the main body portion 51 of the resin portion 50 and the second locking portion 58 locks the engaging portion 49 from below on the front edge and the opposite widthwise side edges of the bracket 40. Specifically, the first and second locking portions 57, 58 provided on the main body 51 of the resin portion 50 lock the embedded portion 41 from below and surround the embedded portion 41 over substantially the entire circumference. Thus, the bracket 40 and the resin portion 50 cannot separate.

Figure 16:
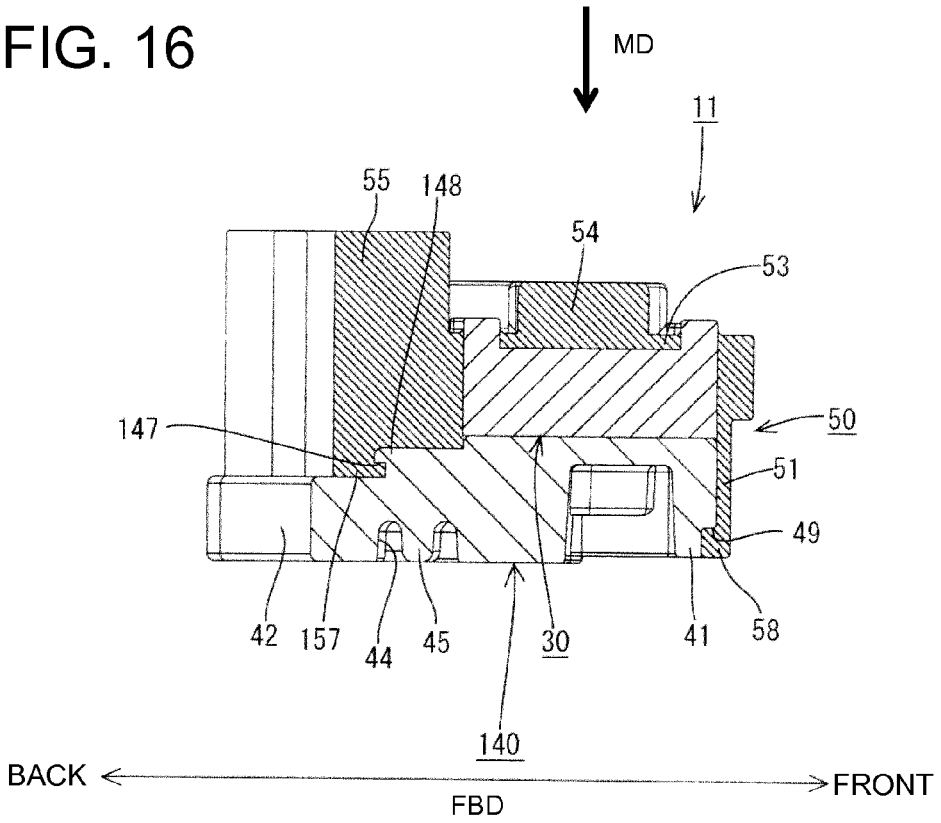
FIG. 16 is a section, equivalent to FIG. 6, in a second embodiment.
Figure 17:
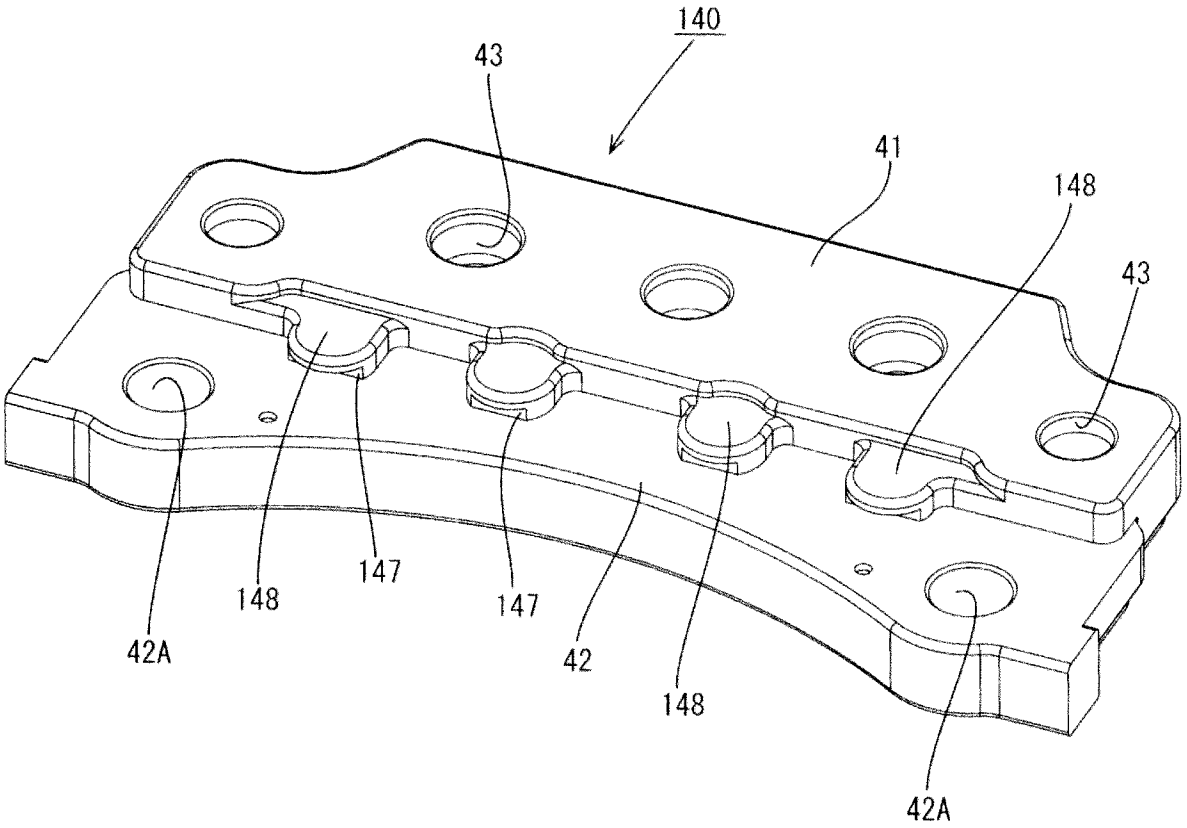
FIG. 17 is a perspective view of a bracket.
Figure 18:
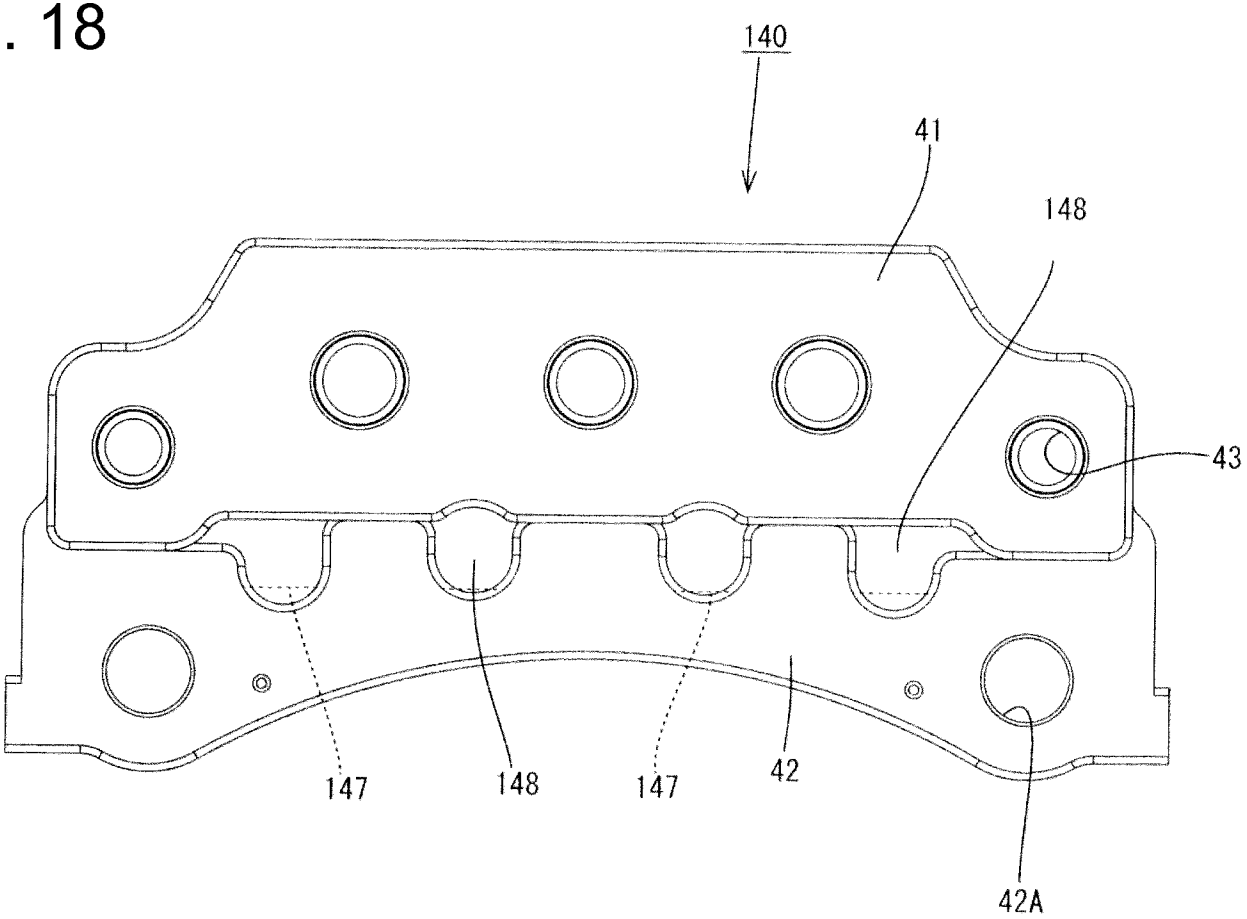
FIG. 18 is a plan view of the bracket.

A second particular embodiment of the present invention is described with reference to FIGS. 16 to 18.

In a terminal block 11 of the second embodiment, the shapes of the build-up portions 48 and the first locking portions 57 of the first embodiment are changed. Configurations, functions and effects similar or common to the first embodiment are not repeatedly described. Further, the similar or same components as those of the first embodiment are denoted by the same reference signs.

Build-up portions 148 of a bracket 140 of the second embodiment are provided with one or more cuts 147 extending in the width direction WD instead of the screw holes. The cuts 147 are recessed forward from the rear end surfaces of the build-up portions 148.

On the other hand, first locking portions 157 of the second embodiment cover the build-up portions 148 from above and enter the cuts 147 from behind. When a resin portion 50 is pulled up, the first locking portions 157 lock the cut portions 147 from below.

When forming vertically recessed cuts in build-up portions, it is thought to form the cut portions in the respective build-up portions individually, for example, using a cutting tool such as a drill, but as many cutting processes as the build-up portions are necessary. However, the cuts 147 of this embodiment can be formed in the build-up portions 148 by cutting the build-up portions 148 straight in the width direction, for example, using a cutting tool such as a T-shaped cutter. This can simplify the cutting process as compared with the case where the cuts are cut individually vertically, for example, using a drill or the like.

The invention is not limited to the above described embodiments. For example, the following embodiments also are included in the scope of the invention.

The busbar B and the terminal T are connected electrically in the above embodiments, but terminals may be electrically connected to each other.

Although the coolant of the motor case is circulated in the heat radiation recess 44 in the above embodiments, the present invention is not limited to such a mode. For example, the entire lower surface of the mounting portion may be held in close contact with the motor case to radiate heat of the bracket to the motor case without providing the radiation recess on the lower surface of the mounting portion.

Although the nut has a substantially rectangular plan view in the above embodiments, the present invention is not limited to such a mode. For example, the nut may have a substantially circular or elliptic plan view.

Although the nuts 20 for neutral point are provided on the opposite widthwise sides of the terminal block 10, 11 in the above embodiments, the invention is not limited to such a mode. For example, the nut for neutral point may be provided only on one side.

What is claimed is:

1. A terminal block for connecting conductive members extending from a device and mating conductive members, comprising:

a bracket to be fixed to a case of the device;

at least one nut configured to fasten at least one of the conductive members and at least one of the mating conductive members together with at least one bolt;

an insulating plate sandwiched between the nut and the bracket, the insulating plate being made of a highly heat conductive synthetic resin containing glass or talc;

at least one guide provided adjacent to the nut and configured to guide the conductive member to the nut by contacting a lateral edge part of the conductive member; and a resin portion that integrally fixes the nuts, the insulating plate and the bracket while holding them one over another in close contact, the resin portion including a nut locking portion for each nut, the nut locking portion locking a step of the nut together with the insulating plate from above to prevent a clearance from being formed between the nut and the insulating plate when the bolt is tightened with the nut, at least one posture correcting portion provided at one or more positions where the conductive members are pulled out to outside from the nut and configured to correct postures at least one of the conductive members in a width direction by contacting at least one of the conductive members pulled out to the outside from the nuts in the width direction.

2. The terminal block of claim 1, wherein the at least one nut comprises plural nut arranged in the width direction and configured to fasten the conductive members and the mating conductive members together with a plurality of bolts, and the at least one guide comprises guides between adjacent ones of the fastening seats.

3. The terminal block of claim 1, wherein the conductive member includes a bolt fastening portion to be placed on the nut in a mounting direction and a wire fixing portion to be fixed to an end of a wire.

4. The terminal block of claim 3, wherein the guide projects adjacent to the bolt fastening portion and between adjacent bolt fastening portions; and wherein the posture correcting portions stand up from the bracket to be arranged at least partly between the wire fixing portions.

5. The terminal block of claim 1, wherein the posture correcting portion is a plate extending in a pull-out direction of the conductive member.

6. The terminal block of claim 1, wherein a projection projects in the width direction over an entire height of the posture correcting portion on an extending end part of each posture correcting portion.

7. The terminal block of claim 6, wherein the projection is configured to contact the conductive member in the width direction when the conductive member is displaced with respect to a pull-out direction.

8. The terminal block of claim 7, wherein the posture correcting portions are not planar.

* * * * *